US005211337A

United States Patent [19]

Lukez

[11] Patent Number: 5,211,337

[45] Date of Patent: May 18, 1993

[54] ROTARY RINSE NOZZLE FOR AIRCRAFT WASTE TANKS

[75] Inventor: Rudy Lukez, Salt Lake City, Utah

[73] Assignee: Edo Corporation/Fiber Science Division, Salt Lake City, Utah

[21] Appl. No.: 892,600

[22] Filed: May 29, 1992

Related U.S. Application Data

[63] Continuation-in-part of Ser. No. 636,746, Jan. 2, 1991, abandoned.

[51] Int. Cl.[5] ..... B05B 3/06

[52] U.S. Cl. ..... 239/251

[58] Field of Search ..... 239/251, 252

[56] References Cited

U.S. PATENT DOCUMENTS 2,880,938 4/1959 Stewart et al. ..... 239/252

3,125,297 3/1964 Copeland et al. ..... 239/251

*Primary Examiner*—Andres Kashnikow

*Assistant Examiner*—Karen B. Merritt

*Attorney, Agent, or Firm*—Thorpe & North & Western

[57] ABSTRACT

A rinse nozzle for an aircraft waste tank includes a tubular member mountable at one end in an opening in the waste tank for receiving cleaning solution through said one end to the interior of the tubular member. The other end of the tubular member extends into the tank and is closed to prevent the exit of cleaning solution out that end. The tubular member has a midsection with a reduced radius and a plurality of first openings circumferentially spaced apart around the midsection. An annular collar is rotatably disposed about the midsection of the tubular member and includes a plurality of second openings disposed thereabout, at least some of which extend outwardly and rearwardly of the direction of rotation of the annular collar to thereby cause the collar to rotate as cleaning solution flows from the tubular member out the first openings against the collar and then out the second openings. A retainer ring is positioned about the tubular member below the midsection to support and hold the collar on the tubular member about the midsection.

1 Claim, 1 Drawing Sheet

ROTARY RINSE NOZZLE FOR AIRCRAFT WASTE TANKS

This application is a continuation-in-part of prior copending application Ser. No. 07/636,746, filed Jan. 2, 1991, of RUDY LUKEZ entitled ROTARY RINSE NOZZLE FOR AIRCRAFT WASTE TANKS, now abandoned.

BACKGROUND OF THE INVENTION

This invention relates to a rinse nozzle for more uniform cleaning of the inside of aircraft waste tanks and the like.

Large leak-free tanks are carried on passenger aircraft for receiving and holding human waste products during passenger flights. At the end of each flight, the tanks are drained of the waste products and, to the extent possible, rinsed or washed to remove any products which may be clinging or sticking to the inside walls of the tanks. This is currently done by mounting fixed position spray nozzles, having no moving parts, inside the tanks and then supplying water or cleaning solution to the nozzles to be sprayed against the inside walls of the tanks. Such nozzles have typically been bulky, because of the need for numerous spray heads to deliver the cleaning solution in different directions, and oftentimes develop unequally dispersed spray patterns.

The problem of unequal spraying and thus nonuniform cleaning by currently used nozzles is exacerbated when parts of such nozzles become clogged with waste products splashing against the nozzles. Because the nozzles are fixed in position, various exit points may become clogged to prevent the flow therethrough of cleaning solution. Of course, this results in even less uniform cleaning so that some waste products remain in the tank. In turn, with the next use of the tanks, additional waste products cling to the old unremoved products so that a buildup of waste products occurs in the tank, and this cannot be effectively removed or cleaned with existing fixed-position nozzles. The only solution to this problem then is to remove the waste tank for special cleaning which, of course, is very time-consuming and costly.

SUMMARY OF THE INVENTION

It is an object of the invention to provide a simple, easy-to-maintain spray nozzle for use in aircraft waste tanks.

It is also an object of the invention to provide such a nozzle which issues a substantially uniform spray throughout the inside of an aircraft tank to clean waste products from the inside walls thereof.

It is a further object of the invention to provide a lightweight and yet rugged spray nozzle.

It is an additional object of the invention to provide such a spray nozzle capable of remaining substantially clog-free.

The above and other objects of the invention are realized in a specific illustrative embodiment of a spray nozzle which includes a tubular stem, one end of which may be mounted in an opening in an aircraft waste tank so that the other end projects into the waste tank. Said one end of the tubular stem is open to receive cleaning solution or water thereinto, while the other end is closed to prevent the exit of such cleaning solution or water. A multiplicity of openings are formed at a midsection of the stem and are circumferentially spaced apart around the midsection. An annular collar is rotatably positioned about the midsection of the stem so that cleaning solution or water exiting the openings formed in the midsection strike an interior wall of the collar. Openings are formed in the collar to allow the exit and spraying of water or cleaning solution outwardly of the collar. At least some of the collar openings are directed outwardly and in a direction generally opposite that in which the collar rotates. As water or cleaning solution exits from such openings, the collar is caused to rotate and thereby throw the spray uniformly in all directions against the inside walls of the tank. A mounting ring is positioned about the stem below the midsection thereof to hold the annular collar on the stem.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
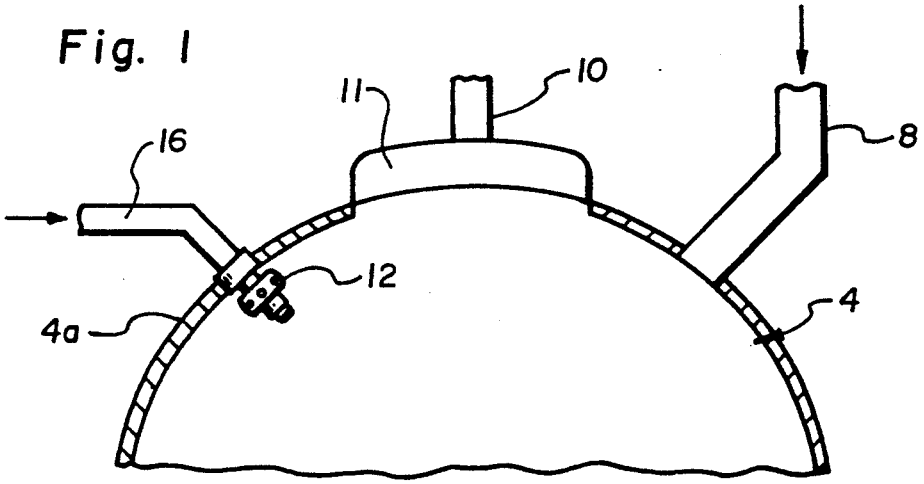
FIG. 1 is a side, partially fragmented view of an aircraft waste tank with the nozzle of the present invention mounted therein.

Referring to FIG. 1, there is shown a fragmented view of an aircraft waste tank 4 into which waste products from passengers and aircraft personnel are delivered via a conduit 8. Another conduit 10 is fitted in a cap 11 to allow escape of air as the tank 4 fills, and also to allow for producing a vacuum in the tank to aid in drawing waste products into the tank. Mounted on an upper sidewall **4*a* of the tank is a rotating rinse nozzle assembly 12 made in accordance with the principles of the present invention. A conduit 16 is coupled to the assembly 12 to deliver water or other cleaning solution thereto and the assembly uniformly disperses the water or solution under pressure to the inside walls of the tank 4. The nozzle assembly 12 might illustratively be mounted in the sidewall 4*a*** of the tank by screwing it into a threaded opening, by disposing the assembly in an opening and securing it with an adhesive, by using a variety of mounting brackets known in the industry for mounting nozzles and similar articles, etc.

Figure 2:
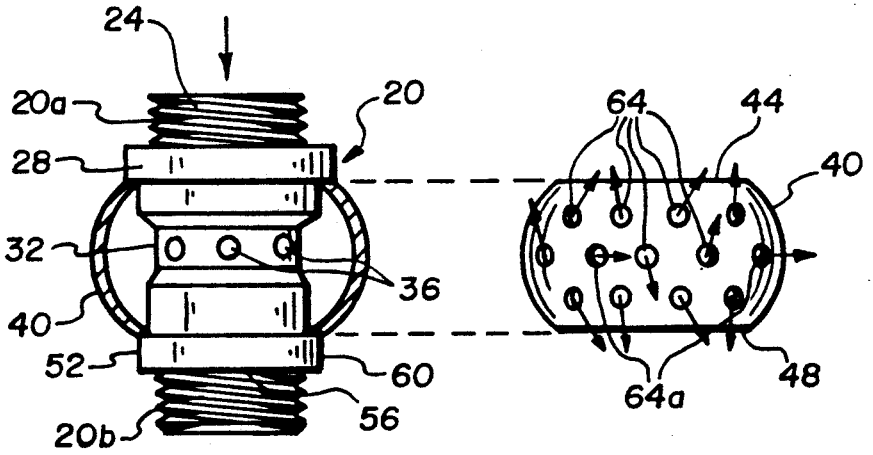
FIG. 2 is a side, elevational, partially cross-sectional view of a rotary nozzle made in accordance with the principles of the present invention.

FIG. 2 shows a side, partially cross-sectional elevational view of the rotating rinse nozzle assembly 12 of FIG. 1. The nozzle includes a tubular stem 20 open at an upper end **20*a* and closed at the other end 20*b*. The upper open end 20*a* includes threads 24** on the exterior surface thereof to enable screwing the assembly into a threaded opening of an aircraft waste tank.

An enlarged shoulder section 28 is formed just below the threads 24, as shown, to provide an abutment and stop for the assembly when it is inserted into an opening of the tank. Spaced below the shoulder section 28 is a midsection 32 having a reduced circumference from the remainder of the stem 20. Those portions of the stem 20 just above and below the midsection 32 have substantially the same circumference, as indicated in FIG. 2.

A plurality of openings 36 are formed in the midsection 32 to allow the exit of water or cleaning solution delivered to the interior of the stem 20. The openings 36 are circumferentially spaced apart about the midsection so as to direct water or cleaning solution radially outwardly from the midsection. The view provided in FIG. 2 shows that the openings 36 are circumferentially arranged about the midsection 32 so as to be spaced apart no more than about sixty degrees.

An annular collar or ball 40 (shown in side cross-section mounted on the stem 20 in FIG. 2 and also shown to the right of the stem in a full side view) is rotatably mounted on the stem so that upper and lower lips 44 and 48 are in sliding contact with those portions of the stem just above and below the midsection 32. A mounting or retaining ring 52 with interior threads, is screwed out of the lower threaded end 20*b* of the stem 20 to retain the collar 40 in place about the stem.

An alternative embodiment of the mounting ring 52 would be to form the interior surface of the ring with a groove and form the exterior of the lower portion of the stem 20 with an oppositely positioned groove. A ring seal would be positioned in the two grooves to fill the space therebetween and hold the mounting ring 52 in position.

Still another embodiment of the nozzle assembly 12 would be to replace the shoulder section 28 with a threaded ring for screwing onto the upper end 20*b* of the stem 20, and to rigidly form the mounting ring 52 as part of the lower end 20*b* of the stem. With this configuration, the collar 40 would simply be slipped over the upper end 20*a* of the stem until it rests on the ring 52, the ring 28 would next be screwed onto threads 24 to a position just above the collar, and then the upper end 20*a* of the stem would be screwed into the threaded opening in the aircraft waste tank.

Advantageously, the stem 20, collar 40 and mounting ring 52 are made of polytetrafluoroethylene.

The collar 40 is formed with a plurality of circumferentially positioned openings 64 at least some of which are directed outwardly and in a direction opposite the direction of rotation of the collar. (Two such openings 64*a* are illustrated in FIG. 2 in which the arrows associated with the openings indicate the direction in which the openings are formed. Since the arrows are shown directed to the right, the collar 40 would be caused to rotate in a direction to the left. [Clockwise if looking down on the top of the collar.]) Other of the openings 64 are formed to be directed outwardly and either downwardly or upwardly, as indicated by the arrows in FIG. 2. The plurality of openings 64 and 64*a* are circumferentially spaced apart no more than about twenty-five degrees, and preferably less than twenty-five degrees, about the collar 40. The number of openings 64 and 64*a* provided by the spacing represented in FIG. 2 ensures that sufficient cleaning action will take place in the aircraft waste tank.

With the openings 64 formed as indicated in FIG. 2, the collar 40 is caused to rotate in a direction determined, for example, by the openings 64*a* when water or cleaning solution supplied to the stem 20 flows through openings 36 and then out of the openings 64. Because the water or cleaning solution would be directed outwardly and in a first direction from the collar 40, the collar would be caused to rotate in a second direction opposite the first direction. Water or cleaning solution would also be flowing or spraying through the other openings 64 in the collar 40 and this would be sprayed throughout the interior of the waste tank 40 of FIG. 1.

With the construction described, a more uniform and thorough cleaning of the inside of an aircraft waste tank is achieved. Because of the rotating collar 40, waste products tend not to cling or clog the spray openings. Further, if the spray openings are clogged during use of the waste tank, such clogging is generally eliminated at the next cleaning of the tank partly because of the centrifugal force created when the collar 40 is caused to rotate. That is, waste products which may have adhered to the exterior of the collar are thrown free by a combination of the spray exiting the openings 64 and the centrifugal force imparted to the waste products.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A rinse nozzle for mounting in an aircraft waste tank which projects at least partly into the interior of the tank, said nozzle comprising a tubular stem having a first end and a second end, made of polytetrafluorethylene, including external threads at the first end, the external threads formed on a sufficient portion of the tubular stem such that they extend through an opening in a wall of the aircraft waste tank and are securely mounted therein so that the second end of the stem extends into the tank interior, and including a plurality of first openings circumferentially spaced no more than about sixty degrees apart in the sidewall of the stem, said stem having a head section with a first radius, a mid-section positioned at the first openings, the mid-section having a second radius which is less than the first radius, and a bottom section having the first radius, said stem being open at said first end for receiving cleaning solution and closed at the second end, an annular collar, made of polytetrafluorethylene, rotatably disposed on the stem about the first openings, said collar including an inner concave surface and an outer convex surface and a plurality of circumferentially positioned second openings, said second openings being spaced apart no more than about twenty-five degrees and at least some of which are directed outwardly and upwardly and at least some of which are directed outwardly and downwardly and in a direction generally opposite to the direction of rotation of the collar, to thereby cause the collar to rotate as cleaning solution supplied to the stem flows through the first openings and out the second openings, and a mounting ring, made of polytetrafluorethylene, fixable on the stem below the collar to support the collar.

* * * * *